US006129242A

United States Patent [19]

Chan

[11] Patent Number: 6,129,242

[45] Date of Patent: Oct. 10, 2000

[54] GOLF BALL DISPENSING APPARATUS

[76] Inventor: Kin-Keung Chan, 4288 5th Avenue, Prince George, British Columbia, Canada, V2M 7A2

[21] Appl. No.: 09/034,236

[22] Filed: Mar. 4, 1998

[51] Int. Cl.[7] ..... B65G 59/00

[52] U.S. Cl. ..... 221/271; 473/136

[58] Field of Search ..... 221/251, 258, 221/289, 268, 271, 272, 276; 473/136, 137

[56] References Cited

U.S. PATENT DOCUMENTS

| | | | |
|---|---|---|---|
| 3,410,452 | 11/1968 | Igel et al. | 221/271 |
| 4,046,286 | 9/1977 | Peppard | 221/251 |
| 4,892,318 | 1/1990 | Jennings | 273/201 |
| 5,096,200 | 3/1992 | Komori et al. | 273/201 |
| 5,372,277 | 12/1994 | Waring | 221/68 |

FOREIGN PATENT DOCUMENTS

WO 94/12247 6/1994 Ireland .

WO 94/07218 3/1994 United Kingdom .

*Primary Examiner*—Kenneth W. Noland

*Attorney, Agent, or Firm*—Oyen Wiggs Green & Mutala

[57] ABSTRACT

A ball dispensing apparatus comprises a container capable of housing a plurality of golf balls and a ball dispenser having a gate member to allow a golfer to selectively control the dispensation of a single golf ball at a time, without requiring the golfer to alter his or her stance prior to each swing or putt. The gate member has first and second gate portions attached by a connecting member, so as to allow the first and second gate portions to reciprocate in unison with each other across an inclined passageway within the ball dispenser. The ball dispenser has a hold position and a dispensing position. In the hold position the first gate portion is retracted from the passageway and the second gate portion extends into the passageway, while in the dispensing position the first gate portion extends into the passageway and the second gate portion is retracted from the passageway. The reciprocation of the gate member between the hold and dispensing positions is controlled by a solenoid plunger and a return spring connected to the gate member.

26 Claims, 3 Drawing Sheets

GOLF BALL DISPENSING APPARATUS

TECHNICAL FIELD

This invention relates to an apparatus for holding a plurality of golf balls and for controllably dispensing a single ball at a time to a predetermined striking location without requiring the golfer to alter his or her stance prior to each swing or putt.

BACKGROUND

Golf ball dispensing and teeing apparatuses for use at driving ranges and the like are well known in the prior art. Representative prior art patent documents include:

U.S. Pat. No. 4,892,318 to Jennings

U.S. Pat. No. 5,096,200 to Komori et al.

U.S. Pat. No. 5,372,277 to Waring

WO 94/07218 to Hagen International (UK) Limited

WO 94/12247 to Lesco Enterprises Limited

Unfortunately, all of the aforementioned prior art references suffer from one or more disadvantages. For example, some devices include systems that dispense or position a ball according to a pre-determined time interval. This has the undesired effect of the golfer either having to wait too long for a ball to be dispensed or being rushed between swings. The present invention aims to overcome this deficiency by allowing the golfer to controllably dispense a single ball when desired.

Another problem encountered in the prior art is that some apparatuses require permanent or semi-permanent installation at a driving range for operability. Unfortunately, mounting a ball dispenser in this manner limits its applications. In contrast, the present invention requires no mounting and is easily transported. As a result, the present invention may be used in any number of different locations including not only a driving range, but also a practise chipping or putting surface or sand bunker.

Finally, some prior devices incorporate complex mechanisms and structures for conveying golf balls from a storage container to a dispenser or for placing a ball on a tee, thus rendering them commercially infeasible or vulnerable to mechanical breakdown over time. The present invention aims to overcome these deficiencies by providing a commercially viable apparatus for holding and dispensing balls that is much less vulnerable to mechanical failure.

SUMMARY OF INVENTION

A golf ball dispensing apparatus is disclosed comprising a container for holding a plurality of golf balls; and a ball dispenser for selectively dispensing the golf balls one at a time from the container to a striking location. The ball dispenser comprises a passageway having an inlet for receiving the golf balls and an outlet; a gate member located between the inlet and the outlet and having first and second portions moveable into the passageway to restrict the passage of the golf balls therethrough; and actuating means to move the gate member between a dispensing position and a hold position. In the dispensing position the first portion of the gate member extends substantially into the passageway and the second portion of the gate member retracts substantially from the passageway, while in the in the hold position the first portion retracts substantially from the passageway and the second portion extends substantially into the passageway.

The apparatus may further include a connecting element connecting the first portion to the second portion such that the first and second portions reciprocate in unison relative to the passageway when the gate member moves between the dispensing and hold positions. The passageway is an elongated conduit having a longitudinal axis and the first and second gate portions move in spaced-apart transverse planes intersecting the longitudinal axis. Preferably the first and second gate portions extend in parallel planes and are longitudinally spaced-apart slightly less than the diameter of one of the golf balls. In the dispensing position, the first gate member physically separates a golf ball to be dispensed from any other golf balls loaded in the passageway. Preferably the passageway slopes downwardly from the inlet to the outlet such that the golf ball to be dispensed rolls from the dispenser to the striking location by gravitational forces. The container may also be inclined to funnel golf balls toward the ball dispenser inlet. Preferably the inlet is sized to accommodate only one ball at a time.

The apparatus may further include means for biasing the gate member toward said hold position. Preferably the biasing means comprises a coil spring connected to an end of the gate member. The actuating means may consist of a mechanical plunger for moving the gate member to the dispensing position against the bias of the spring. Operation of the plunger is preferably controlled by an electric solenoid. The solenoid may be connected to a source of solar power.

A golf ball dispenser component is also disclosed which may be sold and used separate from the golf ball container. The dispenser selectively dispenses golf balls one at a time to a striking location and includes a passageway having an inlet for receiving the golf balls and an outlet; a gate member located between the inlet and the outlet and having first and second portions moveable into the passageway to restrict the passage of the balls therethrough; and actuating means to move the gate member between a dispensing position and a hold position. In the dispensing position the first portion of the gate member extends substantially into the passageway and the second portion retracts substantially from the passageway, while in the in the hold position the first portion retracts substantially from the passageway and the second portion extends substantially into the passageway.

BRIEF DESCRIPTION OF DRAWINGS

In the drawings which illustrate the preferred embodiment of the invention, but which should not be construed as restricting the spirit or scope of the invention in any way.

DESCRIPTION

The invention provides a golf ball dispensing apparatus 10 for holding a plurality of golf balls 12 and controllably dispensing balls 12 one at time to a predetermined ball striking location (such as a driving range mat).

Figure 1:
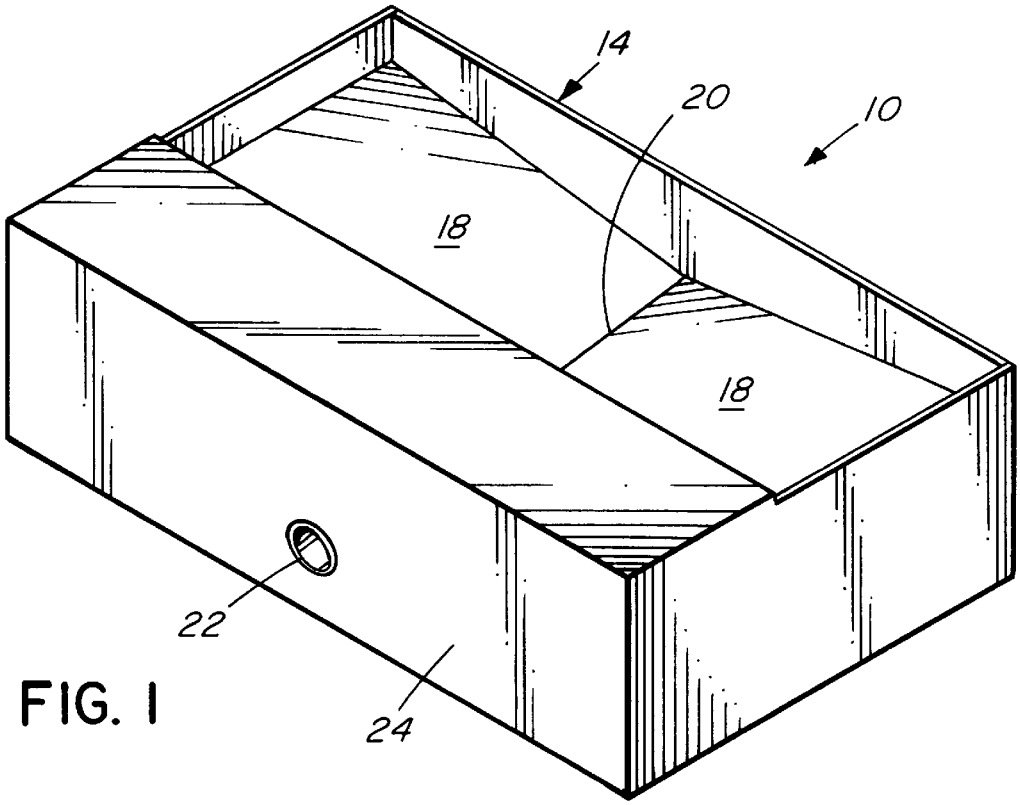
FIG. 1 is a top perspective view of the ball container component of the applicant's golf ball dispensing apparatus.
Figure 2:
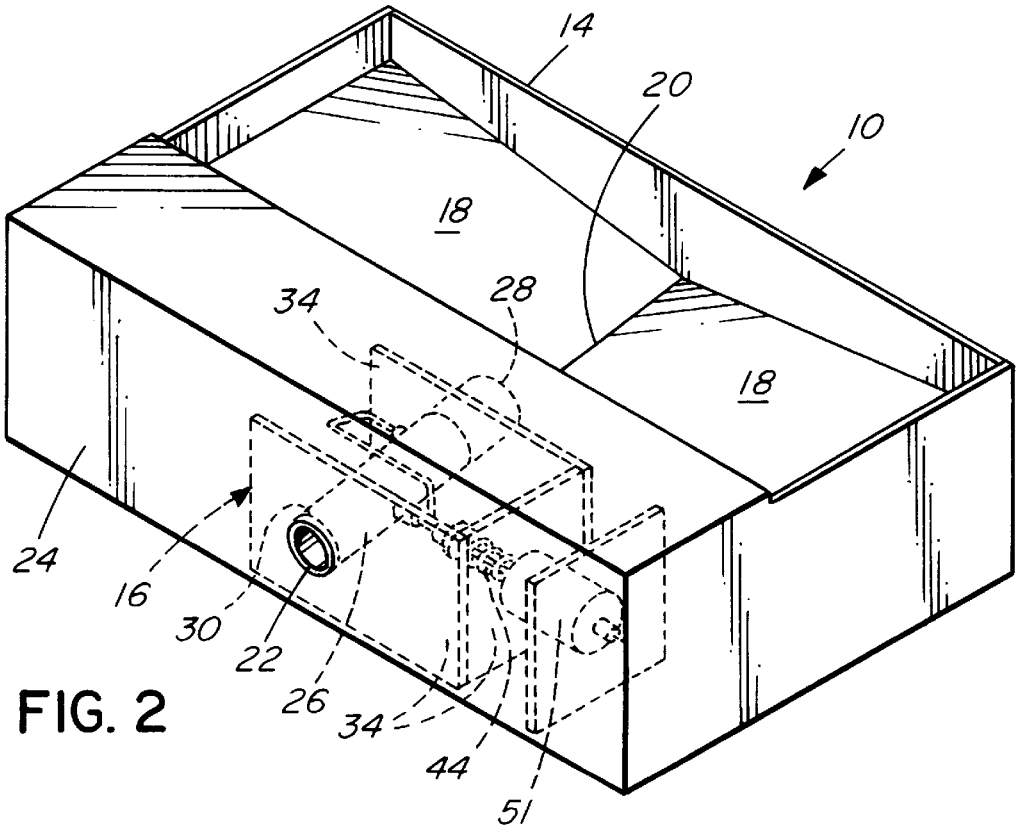
FIG. 2 is a top perspective view of the ball dispenser component of the applicant's golf ball dispensing apparatus shown in dotted outline mounted within the container of FIG. 1.

Dispensing apparatus 10 includes a ball container 14 (FIG. 1) and a ball dispenser 16 (shown in dotted outline in FIG. 2). Container 14 includes opposed bottom panels 18 which are downwardly inclined toward a central trough 20. Trough 20 slopes forwardly for funneling golf balls 12 by gravitational forces toward dispenser 16. In the illustrated embodiment, dispenser 16 is mounted in a forward portion of container 14 for conveying golf balls 12 from trough 20 through an outlet 22 formed in a front panel 24 of container 14. In use, container 14 is positioned so that each ball 12 dispensed through outlet 22 will roll to the desired ball striking position. Container 14 is preferably constructed of a hard, durable plastic so as to be capable of withstanding variable weather conditions.

Ball dispenser 16 includes an elongated passageway 26 having an inlet 28 located at the lowermost end of container trough 20 and an outlet 30 which is aligned with container outlet 22 (FIG. 2). Passageway 26 may comprise, for example, an inclined open-ended tube. The longitudinal axis of passageway 26 is substantially aligned with container trough 20 and is inclined downwardly from inlet 28 to outlet 30. Passageway 26 is supported in the inclined position by a housing 32 consisting of vertical wall panels 34. Inlet 28 is sized to receive only one golf ball 12 at a time from trough 20.

It will be appreciated that passageway 26 need not necessarily be sloped. An alternate embodiment could be imagined whereby balls 12 are automatically and continuously propelled through passageway 26 by a driven component (not shown) rather than by gravity.

Figure 3:
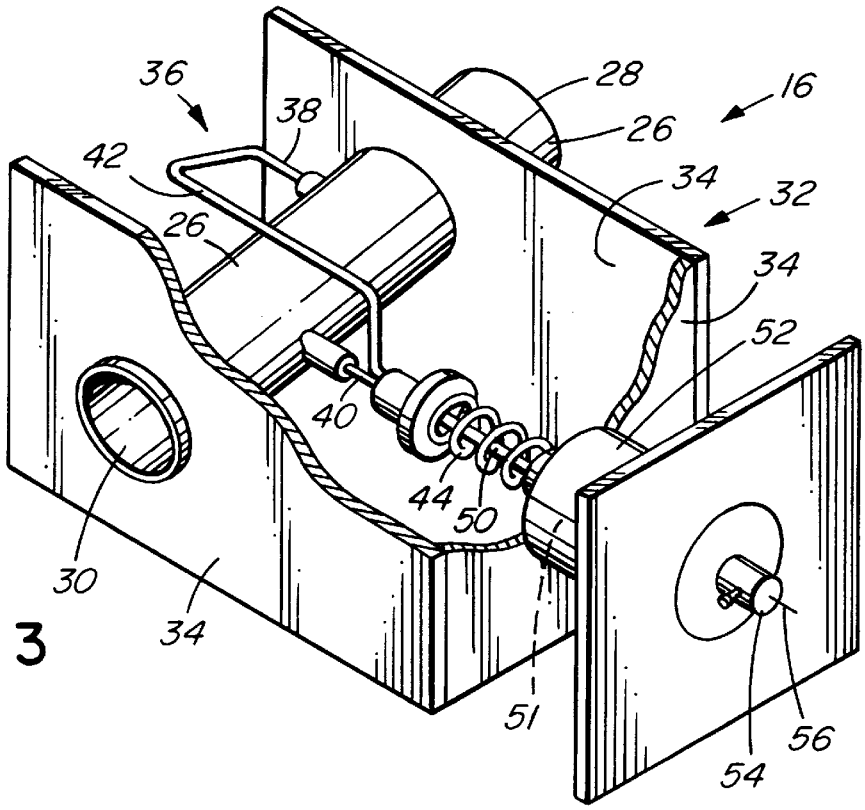
FIG. 3 is a top perspective view of the ball dispenser component of FIG. 3.
Figure 4:
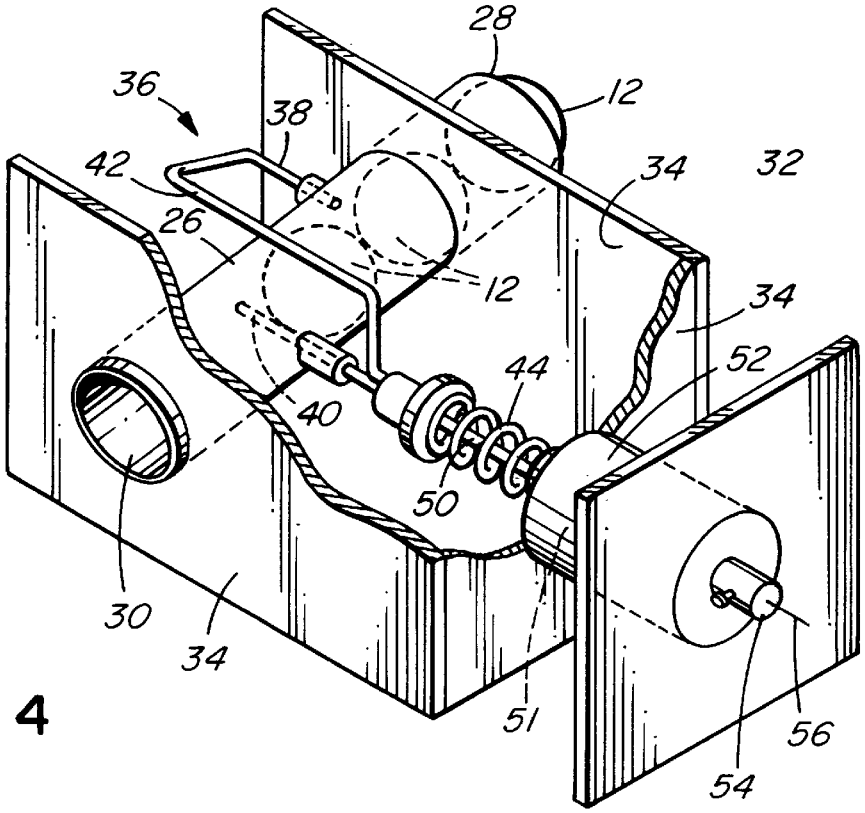
FIG. 4 is a top perspective view of the ball dispenser of FIG. 3 in the hold position showing the first and second portions of the gate member and several golf balls loaded in the ball dispenser in dotted outline.
Figure 5:
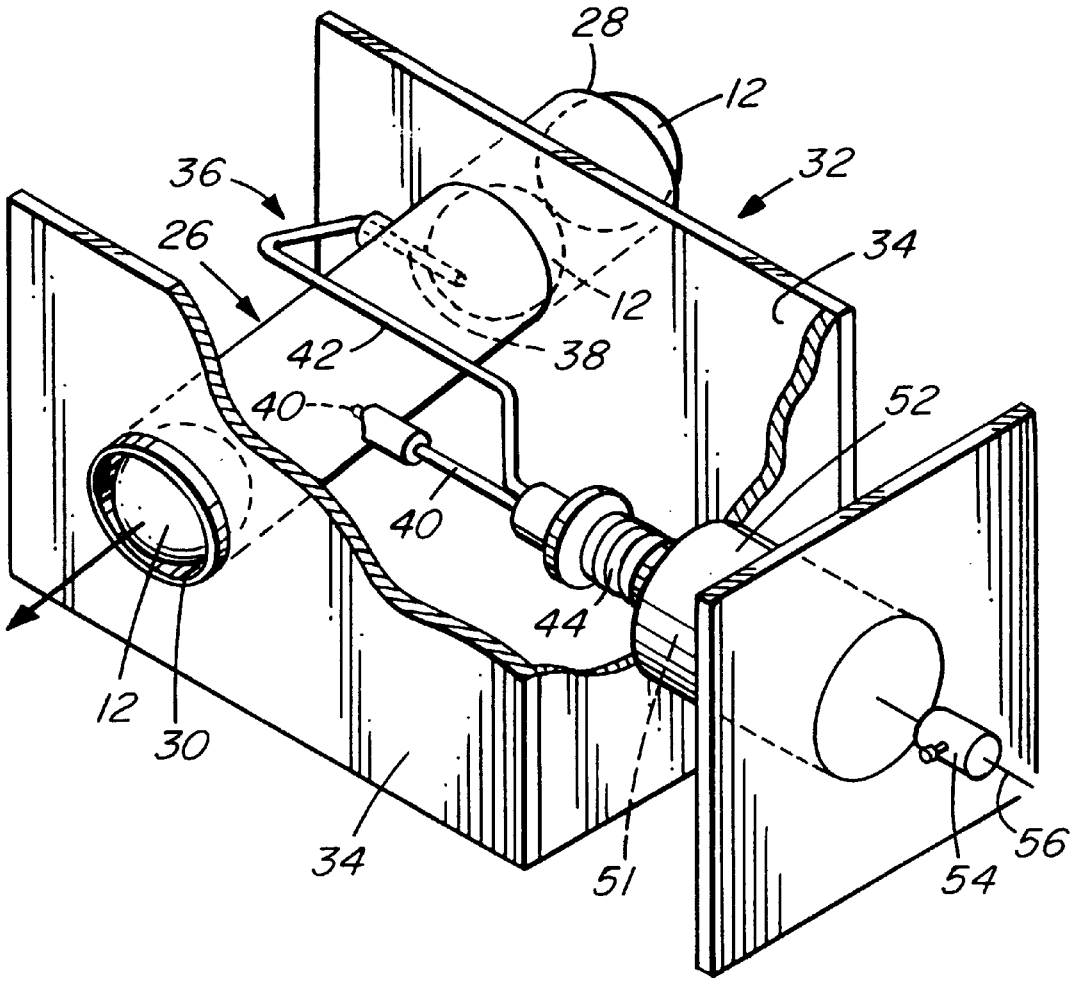
FIG. 5 is a top perspective view of the ball dispenser of FIG. 3 in the dispensing position showing the first and second portions of the gate member and several golf balls loaded in the ball dispenser in dotted outline.

As shown best in FIGS. 3–5, ball dispenser 16 further includes a gate member generally designated 36. Gate member 36 includes a first gate portion 38 and a second gate portion 40 which are joined together by a connecting element 42. Gate portions 38, 40 extend in spaced-apart, parallel planes transverse to the longitudinal axis of passageway 26. As described further below, gate portions 38, 40 reciprocate transversely into and out of the interior of passageway 26 to control the advancement of golf balls 12 moving therethrough. Gate portions 38, 40 are preferably spaced-apart slightly less than the diameter of a single golf ball 12. Portion 38 is disposed at a transverse position closer to passageway inlet 28 than portion 40.

Gate member 36 is moveable between a hold position (FIG. 4) and a dispensing position (FIG. 5). In the hold position, gate portion 40 extends into the interior of passageway 26 to obstruct the passage of golf balls 12 loaded therein and gate portion 38 is substantially retracted from the interior of passageway 26. When gate member 36 is adjusted to the dispensing position of FIG. 5, gate member 40 is substantially retracted from the interior of passageway 26 which permits the forwardmost golf ball 12 loaded in passageway 26 to roll by gravitational forces through outlet 30 (which is aligned with container outlet 22 as shown in FIG. 2). In the dispensing position, gate member 38 extends substantially into the interior of passageway 26 to obstruct the passage of the next-in-sequence golf balls 12. This ensures that only one ball at a time is discharged from apparatus 10 in the dispensing position.

Movement of gate member 36 between the hold and dispensing positions is controlled by user-activated "actuating means". The actuating means may comprise a mechanical plunger 50 which is secured to an intermediate portion of gate portion 40 and is controlled by a solenoid 51. Plunger 50 moves within a solenoid housing 52 through which gate portion 40 extends. A stop member 54 is secured to the end 56 of gate member 40 furthest from passageway 26 as best shown in FIGS. 4 and 5. The position of stop member 54 is adjustable to vary the extent to which gate portion 40 extends into the interior of passageway 26 in the hold position. A return spring 44 is also provided for biasing gate member 36 toward the hold position.

In use, the actuating means may be controlled by a source of direct current (DC) electricity, such as a battery, AC/DC transformer or a solar panel. The switching device (not shown) could include, for example, a manual switch or an electronic remote control device with a relay (such as FM frequency or infrared controls). When the switching device is activated by a user, this causes the solenoid 51 to be energized which moves the plunger 50 in a direction away from passageway 26 due to magnetic induction. Movement of plunger 50 in turn moves the connected gate member 36 to the dispensing position of FIG. 5, allowing a single golf ball 12 to be dispensed as discussed above. In the dispensing position spring 44 is in a contracted state. When the solenoid is deenergized, extension of spring 44 returns gate member 36 to the hold position of FIG. 4. The extent of return movement of the gate member 36 is limited by stop member 54 which contacts an end portion of solenoid housing 52 when gate member 36 has reached the preferred hold position (FIG. 4). As the gate member 36 returns to the hold position, the next-in-sequence golf ball 12 rolls down passageway 26 to rest against gate portion 40.

The ability of the golfer to select between the reciprocating hold and dispensing positions may be controlled by a foot-activated or club head-activated pedal found in close proximity to the golfer (not shown). By activating the pedal, the golfer is able to controllably dispense golf balls 12 to a pre-determined striking location without significantly altering his or her stance or alignment.

The dispensation of golf balls 12 from golf ball dispensing apparatus 10 is made to a striking location (not shown) where a golfer will strike the ball. It will be appreciated that the distance between the striking location and the dispensing apparatus 10 is primarily a function of the angle of inclination of sloped passageway 26. That is, by increasing the angle of inclination of sloped passageway 26, the striking location will be accordingly moved farther away from golf ball dispensing apparatus 10 and vice versa.

As will be apparent to those skilled in the art in the light of the foregoing disclosure, many alterations and modifications are possible in the practice of this invention without departing from the spirit or scope thereof Accordingly, the scope of the invention is to be construed in accordance with the substance defined by the following claims.

What is claimed is:

1. A golf ball dispensing apparatus controllable by a golfer for delivering golf balls to a striking location comprising:

(a) a container for holding a plurality of golf balls;

(b) a ball dispenser for dispensing said golf balls one at a time from said container to said striking location, said dispenser comprising;

(i) a passageway having an inlet for receiving said golf balls and an outlet;

(ii) a gate member located between said inlet and said outlet and having first and second portions moveable into said passageway to restrict the passage of said balls therethrough, (iii) actuating means to move said gate member between a dispensing position and a hold position, wherein:

(1) in said dispensing position, said first portion extends substantially into said passageway and said second portion retracts substantially from said passageway; and (2) in said hold position, said first portion retracts substantially from said passageway and said second portion extends substantially into said passageway, and an activator operable by the golfer at the striking location for selectively activating said actuating means.

2. The apparatus of claim 1, wherein said gate member further comprises a connecting element connecting said first portion to said second portion such that said first and second portions reciprocate in unison relative to said passageway when said gate member moves between said dispensing and hold positions.

3. The apparatus of claim 2, wherein said passageway is an elongated conduit having a longitudinal axis and wherein said first and second gate portions extend in spaced-apart transverse planes intersecting said longitudinal axis.

4. The apparatus of claim 3, wherein said first and second gate portions extend in parallel transverse planes and are longitudinally spaced-apart slightly less than the diameter of one of the golf balls.

5. The apparatus of claim 3, further comprising means for biasing said gate member toward said hold position.

6. The apparatus of claim 3, wherein in said dispensing position said first gate member physically separates a golf ball to be dispensed from any other of said golf balls loaded in said passageway.

7. The apparatus of claim 1, wherein said passageway slopes downwardly from said inlet to said outlet such that said golf balls roll from said dispenser to said striking location by gravitational forces.

8. The apparatus of claim 1, wherein said container comprises a trough for funneling said golf balls toward said inlet.

9. The apparatus of claim 8, wherein said inlet is sized to permit entry of a single one of said golf balls at a time.

10. The apparatus of claim 5, wherein said biasing means comprises a coil spring connected to an end of said gate member and wherein said actuating means further comprises a mechanical plunger for moving said gate member to said dispensing position against the bias of said spring.

11. The apparatus of claim 10, wherein said plunger is controlled by an electric solenoid.

12. The apparatus of claim 11, wherein said solenoid is connected to a solar power source.

13. The apparatus of claim 10, wherein said activator is operatively coupled to said plunger.

14. The apparatus of claim 13, wherein said activator remotely controls movement of said plunger.

15. The apparatus of claim 1, wherein said first and second portions are rods each having a diameter less than the diameter of a golf ball.

16. The apparatus of claim 1, wherein said first and second portions are non-overlapping.

17. The apparatus of claim 1, wherein said second portion is located closest said outlet.

18. The apparatus of claim 2, wherein said gate member reciprocates between said dispensing and hold positions a distance less than the diameter of a golf ball.

19. A ball dispenser controllable by a golfer for selectively dispensing golf balls one at a time to a striking location, said dispenser comprising:

(a) a passageway having an inlet for receiving said golf balls and an outlet;

(b) a gate member located between said inlet and said outlet and having first and second portions moveable into said passageway to restrict the passage of said balls therethrough;

(c) actuating means to move said gate member between a dispensing position and a hold position, wherein:

(i) in said dispensing position, said first portion extends substantially into said passageway and said second portion retracts substantially from said passageway; and (ii) in said hold position, said first portion retracts substantially from said passageway and said second portion extends substantially into said passageway, and (c) an activator operable by the golfer at the striking location for selectively activating said actuating means.

20. The dispenser of claim 19, wherein said gate member further comprises a connecting element connecting said first portion to said second portion such that said first and second portions reciprocate in unison relative to said passageway when said gate member moves between said dispensing and hold positions.

21. The dispenser of claim 20, wherein said passageway is an elongated conduit having a longitudinal axis and wherein said first and second gate portions extend in spaced-apart transverse planes intersecting said longitudinal axis.

22. The dispenser of claim 21, wherein said first and second gate portions extend in parallel transverse planes and are longitudinally spaced-apart slightly less than the diameter of one of said golf balls.

23. The dispenser of claim 19, wherein said passageway slopes downwardly from said inlet to said outlet such that said golf balls roll from said dispenser to said striking location by gravitational forces.

24. The dispenser of claim 19, further comprising means for biasing said gate member toward said hold position.

25. The dispenser of claim 24, wherein said biasing means comprises a coil spring connected to an end of said gate member and wherein said actuating means further comprises a mechanical plunger for moving said gate member to said dispensing position against the bias of said spring.

26. A golf ball dispensing apparatus comprising:

(a) a container for holding a plurality of golf balls;

(b) a ball dispenser for selectively dispensing said golf bails one at a time from said container to a striking location, said dispenser comprising:

(i) a passageway having an inlet for receiving said golf balls and an outlet;

(ii) a gate member located between said inlet and said outlet and having first and second portions moveable into said passageway to restrict the passage of said balls therethrough;

(iii) actuating means to move said gate member between a dispensing position and a hold position, wherein:

(1) in said dispensing position, said first portion extends substantially into said passageway and said second portion retracts substantially from said passageway; and (2) in said hold position, said first portion retracts substantially from said passage way and said second portion extends substantially into said passageway, and wherein said gate member further comprises a connecting element connecting said first portion to said second portion such that said first and second portions reciprocate in unison relative to said passageway when said gate member moves between said dispensing and hold positions;

wherein said passageway is an elongated conduit having a longitudinal axis and wherein said first and second gate portions extend in spaced-apart transverse planes intersecting said longitudinal axis;

further comprising means for biasing said gate member toward said hold position;

wherein said biasing means comprises a coil spring connected to an end of said gate member and wherein said actuating means further comprises a mechanical plunger for moving said gate member to said dispensing position against the bias of said spring, and wherein said plunger is connected to a solar power source.

* * * * *